US008006922B2

(12) United States Patent
Katzer

(10) Patent No.: US 8,006,922 B2
(45) Date of Patent: Aug. 30, 2011

(54) AERATOR OF A PLUMBING FIXTURE

(75) Inventor: Dieter Katzer, Damme (DE)

(73) Assignee: Neoperl GmbH, Mullheim (DE)

( * ) Notice: Subject to any disclaimer, the term of this patent is extended or adjusted under 35 U.S.C. 154(b) by 245 days.

(21) Appl. No.: 10/599,091

(22) PCT Filed: Mar. 15, 2005

(86) PCT No.: PCT/EP2005/002740

§ 371 (c)(1),
(2), (4) Date: Sep. 19, 2006

(87) PCT Pub. No.: WO2005/093174

PCT Pub. Date: Oct. 6, 2005

(65) Prior Publication Data

US 2007/0194154 A1 Aug. 23, 2007

(30) Foreign Application Priority Data

Mar. 25, 2004 (DE) ..... 10 2004 015 183
Aug. 18, 2004 (DE) ..... 10 2004 039 915
Jan. 13, 2005 (EP) ..... 05000562

(51) Int. Cl.
*E03C 1/08* (2006.01)

(52) U.S. Cl. ..... 239/428.5; 239/587.1; 239/590.3; 239/600; 285/146.1

(58) Field of Classification Search ..... 239/428.5, 239/587.1, 587.4, 587.5, 590, 590.3, 590.5, 239/600; 285/146.1, 261
See application file for complete search history.

(56) References Cited

U.S. PATENT DOCUMENTS

| | | | | |
|---|---|---|---|---|
| 2,196,783 | A * | 4/1940 | Shook | 239/587.4 |
| 3,067,953 | A * | 12/1962 | Aghnides | 239/428.5 |
| 3,623,670 | A * | 11/1971 | Wakeman et al. | 239/428.5 |
| 3,902,671 | A * | 9/1975 | Symmons | 239/428.5 |
| 4,200,123 | A * | 4/1980 | Brandelli | 239/587.4 |
| 4,221,336 | A * | 9/1980 | Diamond | 239/428.5 |
| 4,438,537 | A * | 3/1984 | Bickle | 239/587.4 |
| 7,472,846 | B2 * | 1/2009 | Thomas et al. | 239/587.4 |

FOREIGN PATENT DOCUMENTS

| | | |
|---|---|---|
| DE | 1290498 | 3/1969 |
| DE | 7113198 | 8/1971 |
| DE | 3133267 | 3/1983 |
| DE | 3205205 | 6/1983 |
| EP | 0190965 | 1/1986 |

* cited by examiner

*Primary Examiner* — Steven J Ganey
(74) *Attorney, Agent, or Firm* — Volpe And Koenig, P.C.

(57) ABSTRACT

An aerator for a plumbing fixture is provided, especially for a washstand, water basin or tub. The plumbing fixture includes a water outlet that leads to a forward outlet end in which an aerator that is penetrated by the water is pivotally mounted via a swiveling mechanism, particularly a joint, which is removably fixed. The pivotable aerator is mounted within an outer ring that is screwed into the outlet end.

15 Claims, 2 Drawing Sheets

AERATOR OF A PLUMBING FIXTURE

BACKGROUND

The invention relates to an aerator for a plumbing fixture, especially for a washstand, water basin, or tub, with a water outlet. An aerator, through which water flows and which is pivotally mounted via a swiveling mechanism, particularly a joint, is removably fixed to the forward end of the water outlet.

It is known to fix an aerator to the forward end of a water outlet of a mixing faucet via a ball-and-socket joint. Here, the ball-and-socket joint is fixed on the water outlet and the ball has a channel, through which the water flows. Underneath the ball there is an aerator, whose discharge direction can be adjusted based on the ball-and-socket joint. Such a construction leads to a considerable installation height, so that a relatively large part is fixed on the end of the water outlet.

SUMMARY

The objective of the invention is to improve a plumbing fixture with an aerator of the type named above, such that a small installation height is achieved, and especially so that the necessary parts can be housed completely or partially in the end of the water outlet, wherein the pivoting, adjustable jet providing aerator can be screwed into outlet ends of all standard fixtures.

This objective is achieved according to the invention in that the pivoting aerator is mounted within an outer ring, which is fixed, in particular screwed, in the outlet end.

Such an aerator can be screwed into any standard plumbing outlet based on its standard external shape, standard external dimensions, and standard external thread. Consequently, because the aerator lies within the ball/spherical segment of the joint and no additional attachment means are necessary underneath the ball, an especially small installation height is achieved. Furthermore, an especially simple construction with few components is provided.

It is advantageous when the outer side of the aerator has a partially spherical shape and is mounted pivotally in the outer ring with this outer side. Here, the aerator itself forms the inner part of the ball-and-socket joint, so that the aerator is mounted in the outer ring without an intermediate part. This leads to an especially simple and economical construction with few parts.

Especially advantageous is an aerator with a ball-and-socket joint, wherein the aerator is mounted completely or at least partially within the ball of the ball-and-socket joint and wherein the outer ring, in which the ball/spherical segment is mounted, is screwed in the outlet end. In this way, the outer ring with an external thread can correspond in its external dimensions to typical aerators. Here, it is advantageous when the external thread of the aerator has the standard dimensions M2×1 or M28×1.

It is preferred that the ball is formed by a spherical segment. It is also advantageous when the ball/spherical segment is penetrated by an especially cylindrical channel, in which the aerator is inserted.

An especially simple and stable construction for low installation height is achieved when the ball/spherical segment is mounted pivotally within an outer ring. In this way, the bearing on the side facing the outlet end has a sealing ring, which lies between the inside of the outer ring and the outside of the spherical segment, so that a simple and secure seal is achieved.

It is also advantageous when a cylindrical, especially bushing-shaped region is formed on the water outlet side on the spherical segment. Here, the channel wall of the outer ring can be formed so that it expands outwardly, especially conically, in the outlet region, wherein the bushing-shaped region of the ball/spherical segment is led into contact with this expanding channel wall region when pivoted.

It is further advantageous when the outer ring with the external thread can be screwed into an internal thread of the forward end of the water outlet. An especially simple and secure seal is achieved when the sealing ring contacts a region, especially a step in the interior of the water outlet, when the outer ring is screwed into the water outlet, and, in this way can be pressed. Preferably, it the aerator can be screwed into the channel of the ball/spherical segment.

A simple bearing is achieved when an especially cylindrical or partially cylindrical section, which is placed in a correspondingly shaped recess of the ball or of the outer ring, projects on the outer side of the aerator as a bearing.

BRIEF DESCRIPTION OF THE DRAWINGS

An embodiment of the invention is shown in the drawing in a vertical section and is described in more detail below. Shown are FIG. 1 the aerator in a straight alignment, and FIG. 2 the aerator in pivoted position, FIG. 3 an alternative configuration with direct support of the aerator in the outer ring, FIG. 4 the configuration according to FIG. 3 with a perspective view of the aerator.

DETAILED DESCRIPTION OF THE PREFERRED EMBODIMENTS

Figure 1:
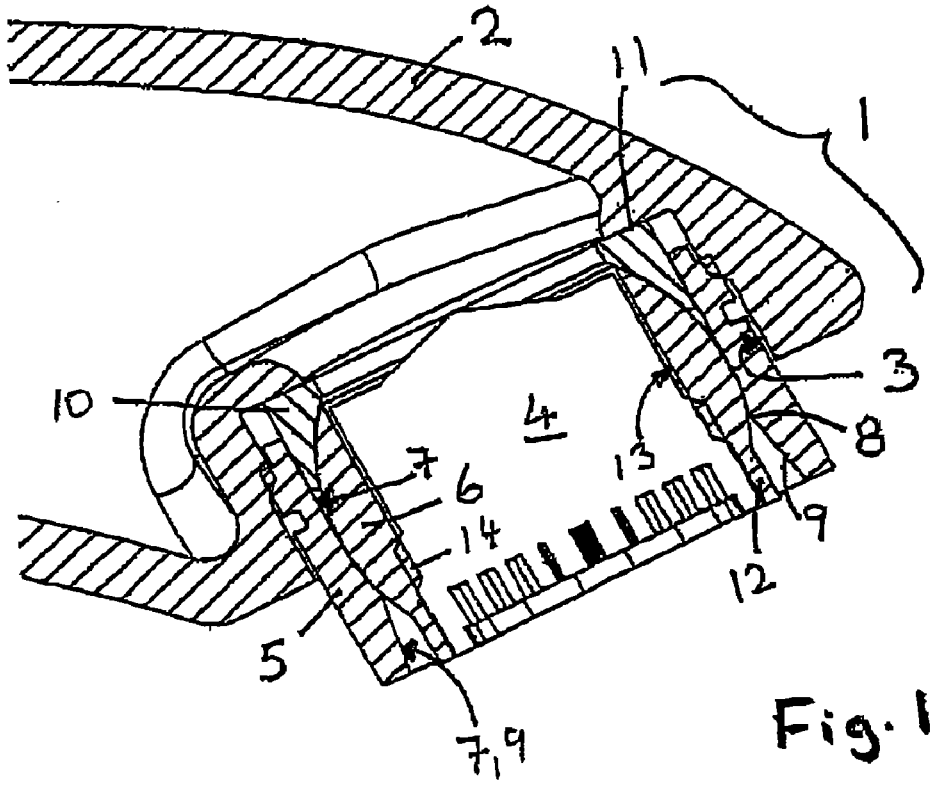
Figure 2:
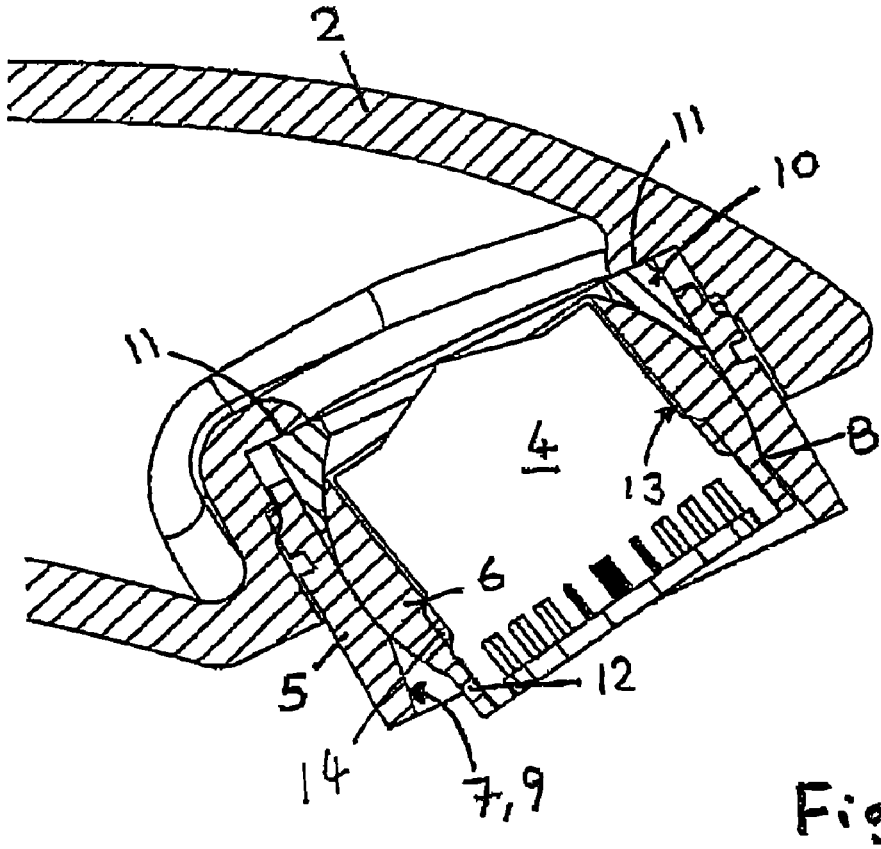

The forward end 1 of a water outlet 2 of a plumbing fixture, especially a one-arm mixing faucet, has a water outlet opening 3, in which an aerator 4 is mounted detachably. For this purpose, the cylindrical outlet opening 3 of the water outlet has an internal thread, in which an outer ring 5 of the aerator can be screwed with its external thread. The external dimensions of the aerator and thus of the outer ring 5 and also the dimensions of the external thread are standard dimensions. Here, the external thread has the size M24×1 or M28×1.

In the interior of the outer ring 5, a ball is mounted in the form of a spherical segment 6. So that the ball or the spherical segment 6 is held securely in the outer ring 5 and cannot fall outwards, the diameter of the channel wall 7 of the outer ring 5 becomes narrower as it extends outwards, in order to form a narrowest point 8, from which the channel wall 7 then expands conically outwards and thus forms a conical expansion 9 at this point. Preferably, the inner side of the outer ring 5 forms a concave bearing for the ball/spherical segment 6.

The ball or spherical segment 6 mounted rotatably in the channel wall 7 is held against the water outlet 2 by a coaxial sealing ring 10, which is pressed and forms a seal when the outer ring 5 is screwed into a gap between the outer ring 5 and ball or spherical segment 6, such that when being screwed in, the top side of the sealing ring 10 is led into contact against a step 11 of the water outlet. Thus, the triangular cross section sealing ring 10 achieves a secure seal between the ball and outer ring, so that the water flows through the aerator 4. In addition, the sealing ring 10 contacts the step 11, so that no water can also escape between the outer ring and the outlet opening 3.

The ball or spherical segment 6 has a cylindrical bushing-shaped region 12, which is formed towards the outlet side and which is led into contact with the conical expansion 9 when the ball/spherical segment pivots, so that the maximum pivoting range of the ball/spherical segment is defined in this way.

Instead of a ball-and-socket joint, the pivotable part of the aerator can also be mounted pivotably by another type of joint, especially an articulated axle with two side pivot pins.

The construction according to the invention achieves especially small external dimensions and, in particular, an especially small installation height, because the components are all inserted or plugged and/or screwed one inside the other.

Figure 3:
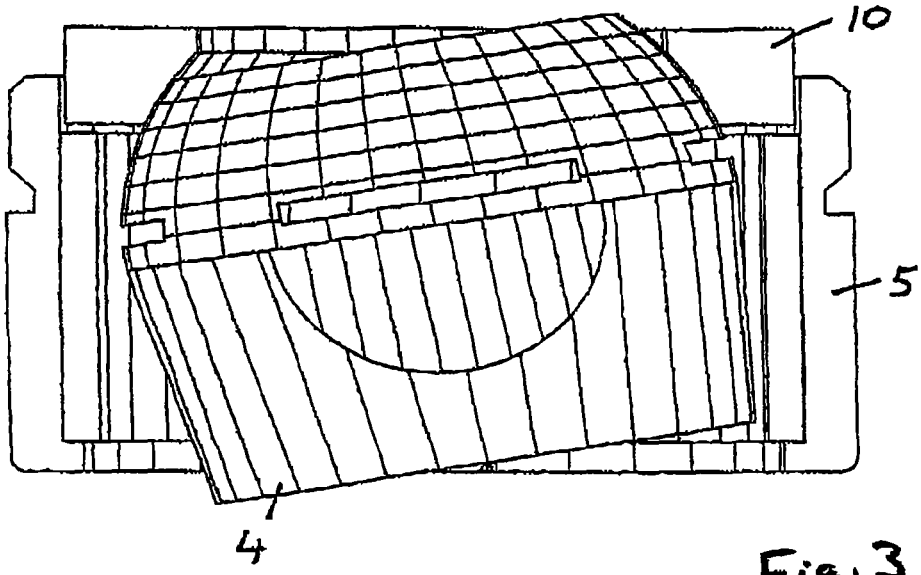
Figure 4:
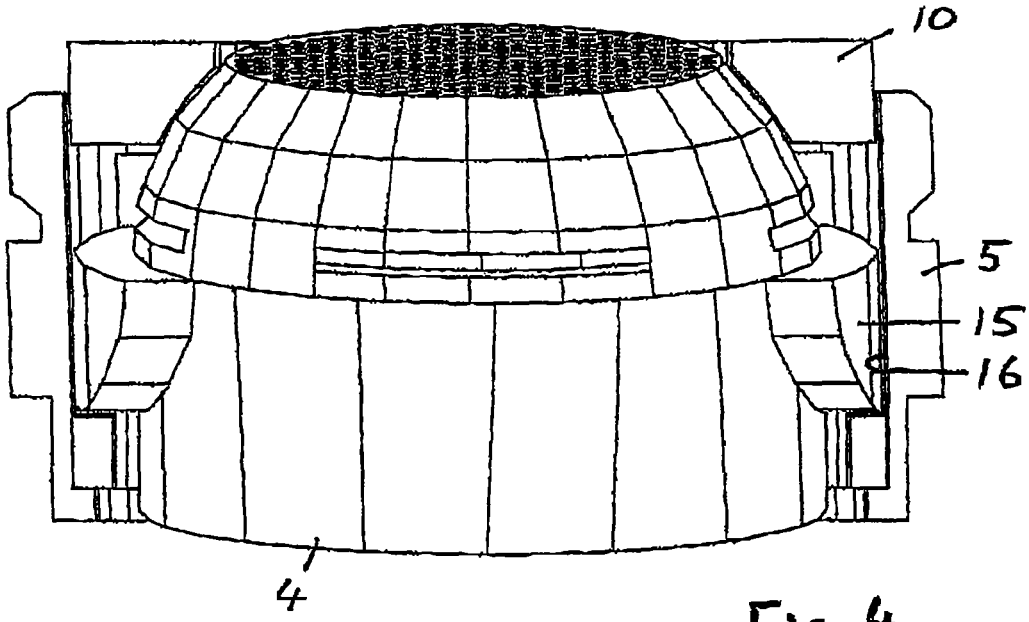

FIGS. 3 and 4 show a structural alternative. Here, the outer side of the aerator 4 is formed with a partial ball shape or as a spherical segment and is mounted in the interior of the outer ring 5, without requiring an intermediate part in the form of the ball or a spherical ring 6. Two cylindrical or partially cylindrical projections 15, which are inserted into corresponding recesses 16 with a positive fit in the inner side of the outer ring 5, are formed on the outer side of the aerator 4 on opposing sides. Alternatively, the inner wall of the outer ring 5 forms a concave ring recess for the spherical segment-shaped outer side of the aerator 4.

The invention claimed is:

1. Aerator for a plumbing fixture, said plumbing fixture having a water outlet (2), comprising an aerator (4), through which water flows, which is pivotally mounted via a swiveling mechanism and is adapted to be removably fixed to an outlet end of the water outlet, the pivotable aerator (4) is mounted within an outer ring (5) which is adapted to be threadingly engaged and at least partially received within the outlet end such that the pivotable aerator is adapted to be located at least partially within the outlet end.

2. Aerator according to claim 1, wherein an outer side of the aerator (4) is partially spherical and is mounted pivotably with the outer side in the outer ring (5).

3. Aerator according to claim 1, wherein an external thread has dimensions that corresponds to typical aerators.

4. Aerator according to claim 1, wherein an external thread of the outer ring has standard dimensions of M24×1 or M28×1.

5. Aerator for a plumbing fixture, said plumbing fixture having a water outlet (2), comprising an aerator (4), through which water flows, which is pivotally mounted via a swiveling mechanism and is adapted to be removably fixed to an outlet end of the water outlet, the aerator (4) is mounted completely or at least partially within a ball or spherical segment (6) of the swiveling mechanism which comprises a ball-and-socket joint, swivelable in any direction, and an outer ring (5) of the ball-and-socket joint, in which the ball or spherical segment is mounted, is adapted to be located so that the outer ring and the aerator are at least partially within the outlet end.

6. Aerator according to claim 5, wherein the ball (6) is formed by a spherical segment.

7. Aerator according to claim 6, wherein a cylindrical, bushing-shaped region (12) is formed on the water outlet side on the spherical segment (6).

8. Aerator according to claim 5, wherein the ball or spherical segment (6) is penetrated by a cylindrical channel, in which the aerator (4) is placed.

9. Aerator according to claim 8, wherein the aerator (4) can be screwed into the channel of the ball/spherical segment (6).

10. Aerator according to claim 5, wherein the ball or spherical segment (6) is mounted pivotably within the outer ring (5).

11. Aerator according to claim 10, wherein the swiveling mechanism on a side facing the outlet end has a sealing ring (10), which lies between an inside of the outer ring and an outside of the spherical segment or an outside of the aerator.

12. Aerator according to claim 11, wherein the sealing ring (10) is adapted to contact a region comprising a step in an interior of the water outlet (2) when the outer ring (5) is screwed into the water outlet and in this way is compressed.

13. Aerator according to claim 5, wherein an inner side of the outer ring (5) forms a concave bearing for the ball or spherical segment (6).

14. Aerator for a plumbing fixture, said plumbing fixture having a water outlet (2), comprising an aerator (4), through which water flows, which is pivotally mounted via a swiveling mechanism and which is adapted to be removably fixed to a forward outlet end of the water outlet, the aerator (4) is mounted completely or at least partially within a spherical segment (6) of the swiveling mechanism which comprises a ball-and-socket joint, and an outer ring (5) of the ball-and-socket joint, in which the spherical segment is mounted, is adapted to be fixed in the outlet end, a cylindrical, bushing-shaped region (12) is formed on the water outlet side on the spherical segment (6), and a channel wall of the outer ring (5) is shaped so that it expands outwardly forming an expanding channel wall region (7) and the bushing-shaped region (12) of the spherical segment (6) comes to lie on the expanding channel wall region (7).

15. Aerator for a plumbing fixture, said plumbing fixture comprising a water outlet (2), with an aerator (4), through which water flows, which is pivotally mounted via a swiveling mechanism and which is removably fixed to a forward outlet end of the water outlet, the pivotable aerator (4) is mounted completely or at least partially within an outer ring (5), which is fixed in the outlet end so that the outer ring and the aerator are at least partially within the outlet end, a cylindrical or partially cylindrical section (15), which is placed in a correspondingly shaped recess (16) of the outer ring (5), projects on an outer side of the aerator (4) as a bearing about which the aerator rotates.

* * * * *